United States Patent [19]

Sandford

[11] 4,203,549

[45] May 20, 1980

[54] RAILWAY SLEEPER

[76] Inventor: Geoffrey P. Sandford, 2-8/10 Brand St., Artarmon, Sydney NSW, Australia, 2064

[21] Appl. No.: 893,608

[22] Filed: Apr. 4, 1978

[30] Foreign Application Priority Data

Apr. 7, 1977 [AU] Australia ..... PC 9710

[51] Int. Cl.[2] ..... E01B 3/20

[52] U.S. Cl. ..... 238/111; 238/110

[58] Field of Search ..... 238/109, 112, 116, 283, 238/349

[56] References Cited

U.S. PATENT DOCUMENTS

| | | | |
|---|---|---|---|
| 161,153 | 3/1875 | Porter et al. | 238/109 |
| 889,777 | 6/1908 | Ebinger et al. | 238/116 |
| 1,026,341 | 5/1912 | Burch | 238/110 |
| 1,227,345 | 5/1917 | Tonn | 238/116 |
| 2,037,315 | 4/1936 | Etheridge | 238/110 |
| 2,531,577 | 11/1950 | McGrew | 238/349 |

FOREIGN PATENT DOCUMENTS

| | | | |
|---|---|---|---|
| 2106853 | 9/1971 | Fed. Rep. of Germany | 238/349 |
| 365 | of 1857 | United Kingdom | 238/109 |
| 1434560 | 5/1976 | United Kingdom | 238/349 |

*Primary Examiner*—Joseph F. Peters, Jr.
*Assistant Examiner*—Ross Weaver
*Attorney, Agent, or Firm*—Emory L. Groff, Jr.

[57] ABSTRACT

A railway sleeper component and a sleeper made from two such components joined by a gauge bar. The sleeper components being characterized by a top and a base joined by hollow columns with webs between the columns. Each component including means whereby a rail may be mounted on the top of the column together with an end of the gauge bar. The columns are hollow and are open at the base and at or near the top to permit grout to be admitted at the top to flow through the base and into the rail bed ballast to bind the components to the road bed.

2 Claims, 7 Drawing Figures

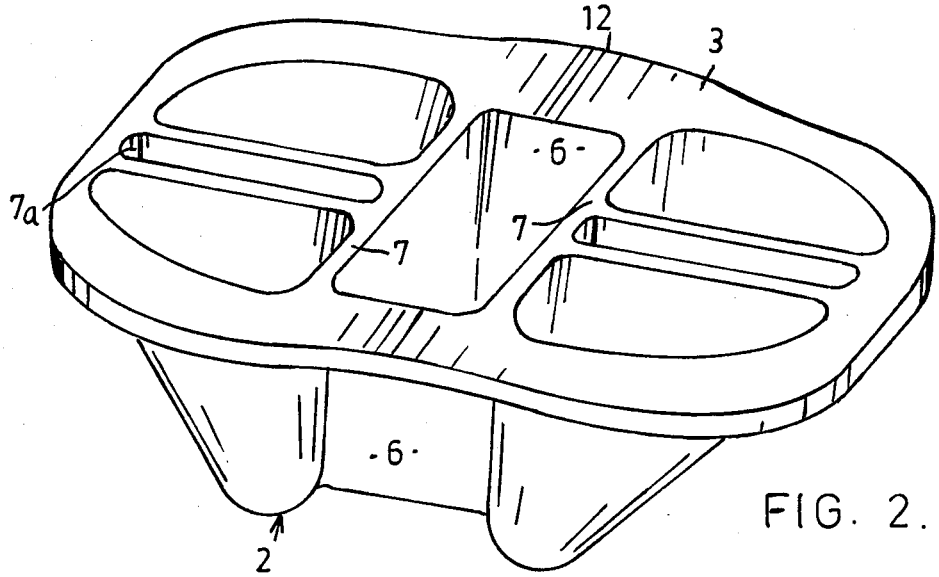
FIG. 2.
FIG. 4.
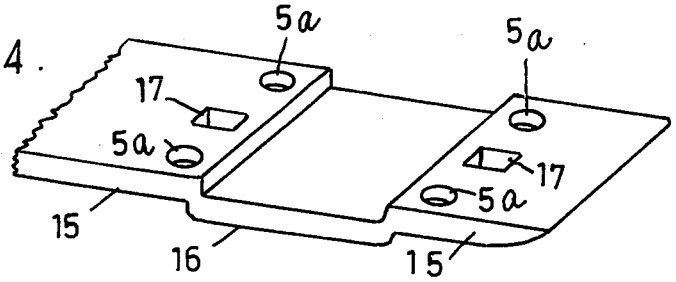
FIG. 5.
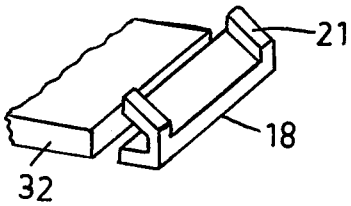
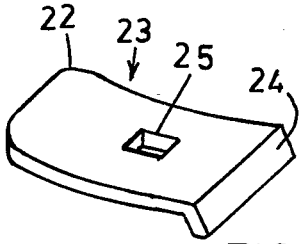
FIG. 6.
FIG. 7.
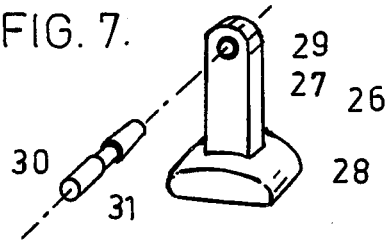

RAILWAY SLEEPER

This invention relates to railway sleepers.

Hitherto railway sleepers have been mainly made of timber although concrete, steel and cast-iron sleepers have been successfully used.

The problems with the aforementioned sleepers are several. Firstly, timber sleepers are liable to wood rot, termite attack and will burn, beside being too flexible for the high axle loads of modern rolling stock. Concrete sleepers are very heavy and costly to make relative to their life span. Steel and cast-iron sleepers as made hitherto have been unacceptable for high axle loads.

The object of this invention is to provide a sleeper made mainly of castable metal which is designed with a view to strength, light weight and reasonable cost.

The sleeper of this invention, in a presently preferred form comprises a three part structure, two end components and a joining member. The end components are themselves novel and it is to such components that the invention is primarily directed.

According to the invention there is provided a railway sleeper component having a base and a top, a plurality of columns joining the base to the top, webs joining the columns, said top having means to be engaged by fasteners to fasten a section of railway line thereto, said component having means to be engaged by said fasteners to couple an elongated gauge-bar-joining-member thereto so as to lie transverse to the said section of railway line when fastened to said component and whereby said component can be coupled to another like component, holes extending through at least some of said columns and through said base whereby grout can be introduced at or near the upper ends of the columns and discharged below said base.

A presently preferred embodiment of the invention is described with reference to the accompanying drawings in which:

FIG. 2 is a perspective view of the railway sleeper component looking from below;

FIG. 4 is a perspective view of one end of a gauge bar for connecting two components as illustrated in FIGS. 1 and 2 together;

FIG. 5 is a perspective view of a shoulder pad for use in connecting a rail to a component;

FIG. 6 is a spring plate for use with the shoulder pad of FIG. 5; and

FIG. 7 is a perspective view of a key and a pin used for connecting the spring plate of FIG. 6 to the component illustrated in FIGS. 1 and 2.

Figure 1:
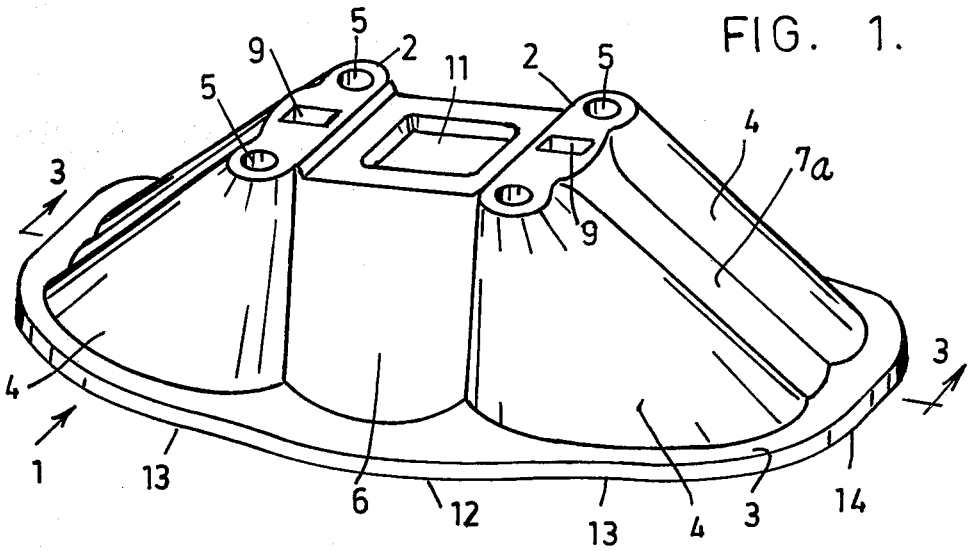
FIG. 1 is a perspective view of the railway sleeper component looking from above.

The drawings show the component 1 made up of a top 2 and a base 3 joined by four columns 4. The columns 4 are hollow and increase in cross-section from the top to the base. There is a hole 5 in the top 2 over each column whereby grout can be introduced (under pressure) to bond the base of the component 1 into the permanent way ballast.

The columns 4 are arranged in two pairs with the pairs joined by webs 6 and the columns of each pair are joined by webs 7 and 7*a* to form a "box" section including two columns, the two box sections being formed by the said webs 6. The space 8 between the columns of each pair allows access to the underface of the top 2 from below the base 3 so as to permit the insertion of keys to be described later through rectangular section openings 9 through the top 2.

The top 2 has a shallow channel 10 thereacross in the direction in which a railway line will be mounted on the component 1. For savings in material, and lightness, a hole 11 is provided through the top 2.

The base 3 is undulating on its underface having a central crest 12 which is aligned with the channel 10, there is a valley 13 to each side of the crest 12 and there is a sub-crest 14 at each end of the base 3. The undulating shape of the base serves to bed the base in the ballast and provides zones of raised ballast (in the valleys) to resist endwise motion of the component 1.

The component 1 is intended to be coupled to a like component by a gauge-bar-joining-member 15 having downset parts 16 to register with the channels 10 of the tops 2 of two components 1. There is an opening 17 through the gauge bar at each side of the downset portion 16 which openings 17 align with the openings 9 of the tops 2 and are shaped similarly thereto. There are also holes 5*a* in the gauge bar to align with the holes 5 in the top 2.

The gauge-bar-component assembly (which constitutes a sleeper) is retained in an assembled manner with two sections of rail by means of two resilient shoulder pads 18 to engage the edges of the lower flange 19 of a section of railway line 20. The pads 18 have angled upper grooved legs 21. The grooves in legs 21 receive the ends 22 of spring plate 23 which are provided at their other ends with feet 24. There is a hole 25 through each plate 23 to line up with openings 9 and 17. A key 26 with a rectangular section shank 27 adapted to be a sliding and neat fit through the openings 9, 17 and 25 is provided with a head 28. The shank 27 is passed upward from the base and is passed through the openings 9, 17 and 25 to extend above the spring plate 23. A pin hole 29 is, in this condition, partially exposed above the spring plate 23 and a retaining pin is driven into the pin hole to place the plate 23 under load. The pin 30 is preferably tapered at its leading end and has a step 31 to prevent it from vibrating loose from engagement in the hole 29 in the shank 27. The arrangement is best seen in FIG. 3 where it is clear that the head 28 bears against the underface of the top 2 and the key shank is placed in tension as a result of the bearing of the pin 30 against the upper face of the plate 23.

Figure 3:
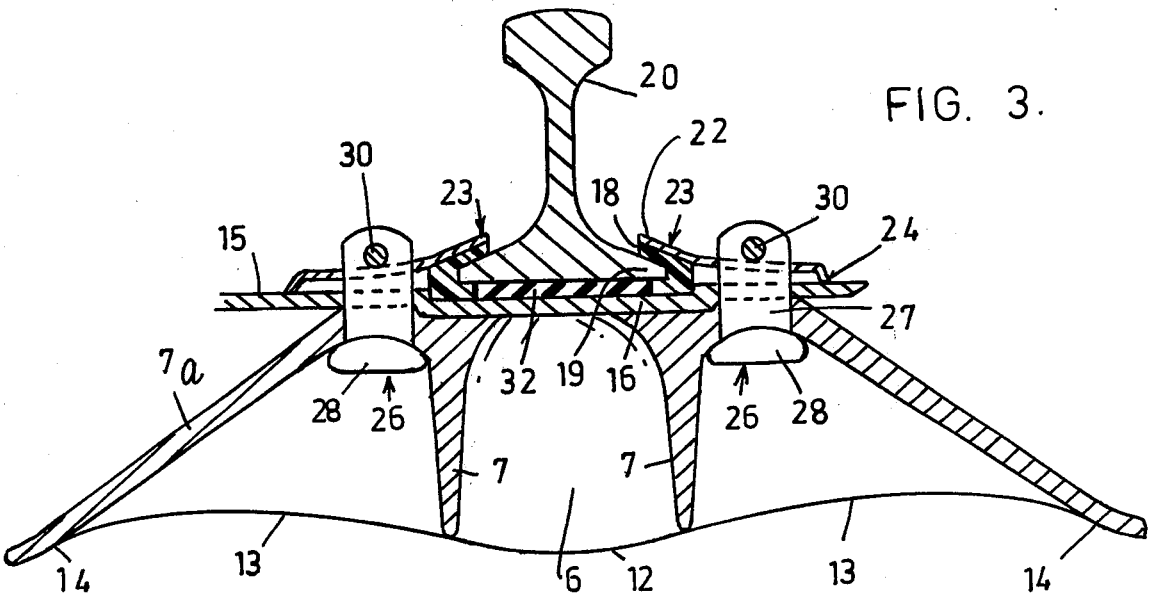
FIG. 3 is a section of the component of FIG. 1 on line 3—3 when assembled with a section of railway line and means for coupling the section of railway line to the component.

It is also to be noted from FIG. 3 that the flange of the rail sits on a resilient underpad 32 located between the shoulder pads 18. The underpad 32 is, when unstressed thicker than the underpart of the shoulder pad 18. When stressed (loaded by the weight of the rail 20) the two pads compress to substantially the same thickness due to the greater compressibility of the underpad 32.

The keys 27 can be secured in the openings 9 by an appropriate adhesive to facilitate the assembly of the bar 15 on the components 1 and the plates 23 on the keys 27.

I claim:

1. A unitary railway sleeper component comprising, an elongated base which is considerably longer than it is wide, a body on the upper surface of the base, a flange portion of the base surrounding and extending beyond the body, an undulating undersurface on the base made up of crests and valleys in the width direction of the base, two pairs of grout cavities extending into the body from the base, the cavities of each pair being aligned in the width direction of the base, two fastening cavities respectively disposed between the cavities of each pair of grout cavities, the pairs of grout cavities being located one pair adjacent each end of the base, a box cavity separating the pairs of grout cavities, openings in the top of the body respectively communicating with the body cavities, a depressed region in the top of the body extending in the width direction of the base to provide two spaced apart raised lands, three openings in each land communicating respectively with a pair of grout cavities and the fastening cavity therebetween, said grout cavities decreasing in cross-section from the base to the body top.

2. A railway sleeper component as claimed in claim 1 wherein, there is a central downwardly directed crest on the base which will lie directly below said depressed region with a valley to each side of said crest which valleys extend from said central crest to two further crests respectively located at the said ends of the base.

* * * * *